US010612272B2

(12) United States Patent
Wu et al.

(10) Patent No.: US 10,612,272 B2
(45) Date of Patent: Apr. 7, 2020

(54) ELECTRONIC LOCK AND METHOD FOR POSITIONING THE ELECTRONIC LOCK

(71) Applicant: TONG LUNG METAL INDUSTRY CO., LTD., Minxiong Township (TW)

(72) Inventors: Tsung-Li Wu, Chiayi (TW); Tsung-Chung Huang, Minsyong Township (TW); Ruei-Jie Jeng, Jhuci Township (TW); Chun-Yi Fang, Huwei Township (TW)

(73) Assignee: Tong Lung Metal Industry Co., Ltd., Chiayi County (TW)

( * ) Notice: Subject to any disclaimer, the term of this patent is extended or adjusted under 35 U.S.C. 154(b) by 37 days.

(21) Appl. No.: 16/016,883

(22) Filed: Jun. 25, 2018

(65) Prior Publication Data

US 2019/0003207 A1 Jan. 3, 2019

(30) Foreign Application Priority Data

Jun. 28, 2017 (TW) ..... 106121576 A

(51) Int. Cl.
*E05B 47/02* (2006.01)
*E05B 47/00* (2006.01)

(52) U.S. Cl.
CPC ..... *E05B 47/0012* (2013.01); *E05B 47/026* (2013.01); *E05B 2047/002* (2013.01); *E05B 2047/0052* (2013.01)

(58) Field of Classification Search
CPC ..... E05B 47/0012; E05B 2047/0052; E05B 47/026; E05B 2047/002
USPC ..... 340/5.73
See application file for complete search history.

(56) References Cited

U.S. PATENT DOCUMENTS 4,568,998 A * 2/1986 Kristy ..... G07C 9/00182 340/5.64
4,591,773 A * 5/1986 Numata ..... H02H 7/0851 318/434
8,490,445 B2 * 7/2013 Chiou ..... E05B 47/0012 70/224

(Continued)

FOREIGN PATENT DOCUMENTS

CA 2944232 A1 9/2015
CA 2888694 A1 10/2015

OTHER PUBLICATIONS

Office Action issued to Canadian counterpart application No. 3009215 by the Canadian Intellectual Property Office dated Mar. 26, 2019 (8 pages).

*Primary Examiner* — Nay Tun
(74) *Attorney, Agent, or Firm* — Michael Best & Friedrich LLP

(57) ABSTRACT

An electronic lock includes a lock mechanism operable to change a state thereof between a lock state and an unlock state, and an electric control device including a motor module and a controller. The motor module is electrically operable to perform a lock operation or an unlock operation on the lock mechanism. The controller is configured to, when the lock mechanism changes the state thereof, determine whether a driving current provided to drive operation of the motor module satisfies a predetermined current condition. The controller stops driving operation of the motor module after determining at least that the driving current satisfies the predetermined current condition.

17 Claims, 8 Drawing Sheets

(56) References Cited

U.S. PATENT DOCUMENTS

| | | | | |
|---|---|---|---|---|
| 8,540,291 | B2 * | 9/2013 | Bliding | E05B 17/0062 292/201 |
| 9,567,773 | B2 * | 2/2017 | Dore Vasudevan | E05B 47/0012 |
| 10,174,525 | B2 * | 1/2019 | Arlinghaus | E05B 65/1053 |
| 2004/0045330 | A1 * | 3/2004 | Moon | E05B 47/0673 70/107 |
| 2008/0223093 | A1 * | 9/2008 | Amir | E05B 47/0012 70/283.1 |
| 2010/0127517 | A1 * | 5/2010 | Bliding | E05B 17/0062 292/341.16 |
| 2013/0192316 | A1 * | 8/2013 | McKibben | E05B 47/0001 70/278.1 |
| 2015/0097380 | A1 * | 4/2015 | Nye-Hingston | E05B 63/14 292/201 |
| 2015/0184426 | A1 * | 7/2015 | Arlinghaus | E05B 65/1053 292/138 |
| 2015/0240529 | A1 * | 8/2015 | Dore Vasudevan | E05B 47/0012 70/277 |
| 2015/0308157 | A1 * | 10/2015 | Lin | E05B 63/04 292/144 |
| 2019/0003207 | A1 * | 1/2019 | Wu | E05B 47/026 |

* cited by examiner

ELECTRONIC LOCK AND METHOD FOR POSITIONING THE ELECTRONIC LOCK

CROSS-REFERENCE TO RELATED APPLICATION

This application claims priority of Taiwanese Invention Patent Application No. 106121576, filed on Jun. 28, 2017.

FIELD

The disclosure relates to a lock apparatus, and more particularly to an electronic lock.

BACKGROUND

To enhance security and prevent users from being locked out when not bringing a key, the users may choose to use electronic locks. A conventional electronic lock may be operated using either touch control operation or the traditional operation using a physical, mechanical key. Such an electronic lock usually includes a lock bolt module, a transmission module to drive the lock bolt module to change between a lock state and an unlock state, a user-input device, and an electric control device communicatively connected to the user-input device and physically connected to the transmission module. The electric control device is configured to cause the transmission module to drive the lock bolt module, and usually has multiple micro switches that can be triggered by the transmission module, so that changing of the state of the lock bolt module may be detected based on the triggering or non-triggering of the micro switches. However, the use of the multiple micro switches may result in problems of space arrangement of elements in the lock and may also incur relatively high cost.

SUMMARY

Therefore, an object of the disclosure is to provide an electronic lock that can alleviate at least one of the drawbacks of the prior art.

According to the disclosure, the electronic lock includes a lock mechanism and an electric control device. The lock mechanism includes a lock bolt module operable to change a position state thereof between a lock state and an unlock state, and a transmission module connected to the lock bolt module. The transmission module is operable to drive the lock bolt module to change the position state. The electric control device includes a motor module and a controller. The motor module is connected to the transmission module, and is electrically operable to perform a lock operation in which the motor module causes the transmission module to drive the lock bolt module to change the position state to the lock state, and an unlock operation in which the motor module causes the transmission module to drive the lock bolt module to change the position state to the unlock state. The controller includes a driver module, a current detecting module and a control module. The driver module is electrically connected to the motor module, and is configured to output a driving current to the motor module for driving operation of the motor module. The current detecting module is disposed to detect the driving current. The control module is electrically connected to the driver module and the current detecting module, and is configured to control the driver module to drive operation of the motor module upon receipt of one of a lock instruction and an unlock instruction. The control module is further configured to, when the lock bolt module changes the position state thereof, determine whether the driving current detected by the current detecting module satisfies a predetermined current condition, and control the driver module to stop driving operation of the motor module after determining at least that the driving current detected by the current detecting module satisfies the predetermined current condition.

Another object of the disclosure is to provide an electric control device that can alleviate at least one of the drawbacks of the prior art.

According to the disclosure, the electric control device is for use in an electronic lock that includes a lock mechanism operable to change a state thereof between a lock state and an unlock state. The electric control device includes a motor module and a controller. The motor module is connected to the lock mechanism, and is electrically operable to perform a lock operation in which the motor module causes the lock mechanism to change the state to the lock state, and an unlock operation in which the motor module causes the lock mechanism to change the state to the unlock state. The controller includes a driver module, a current detecting module and a control module. The driver module is electrically connected to the motor module, and is configured to output a driving current to the motor module for driving operation of the motor module. The current detecting module is disposed to detect the driving current. The control module is electrically connected to the driver module and the current detecting module, and is configured to control the driver module to drive operation of the motor module upon receipt of one of a lock instruction and an unlock instruction. The control module is further configured to, when the lock mechanism changes the position state thereof, determine whether the driving current detected by the current detecting module satisfies a predetermined current condition, and control the driver module to stop driving operation of the motor module after determining at least that the driving current detected by the current detecting module satisfies the predetermined current condition.

Yet another object of the disclosure is to provide a method for positioning of an electronic lock, and the method can alleviate at least one of the drawbacks of the prior art.

According to the disclosure, the electronic lock includes a lock mechanism and a motor module. The lock mechanism includes a lock bolt module operable to change a position state thereof between a lock state and an unlock state, and a transmission module connected to the lock bolt module and operable to drive the lock bolt module to change the position state. The method includes steps of: (A) detecting a driving current that is used to drive operation of the motor module in one of a lock operation in which the motor module causes the transmission module to drive the lock bolt module to change the position state to the lock state, and an unlock operation in which the motor module causes the transmission module to drive the lock bolt module to change the position state to the unlock state; and (B) upon determining at least that the driving current detected in step (A) satisfies a predetermined current condition, stopping operation of the motor module.

BRIEF DESCRIPTION OF THE DRAWINGS

Other features and advantages of the disclosure will become apparent in the following detailed description of the embodiment(s) with reference to the accompanying drawings, of which.

DETAILED DESCRIPTION

Figure 1:
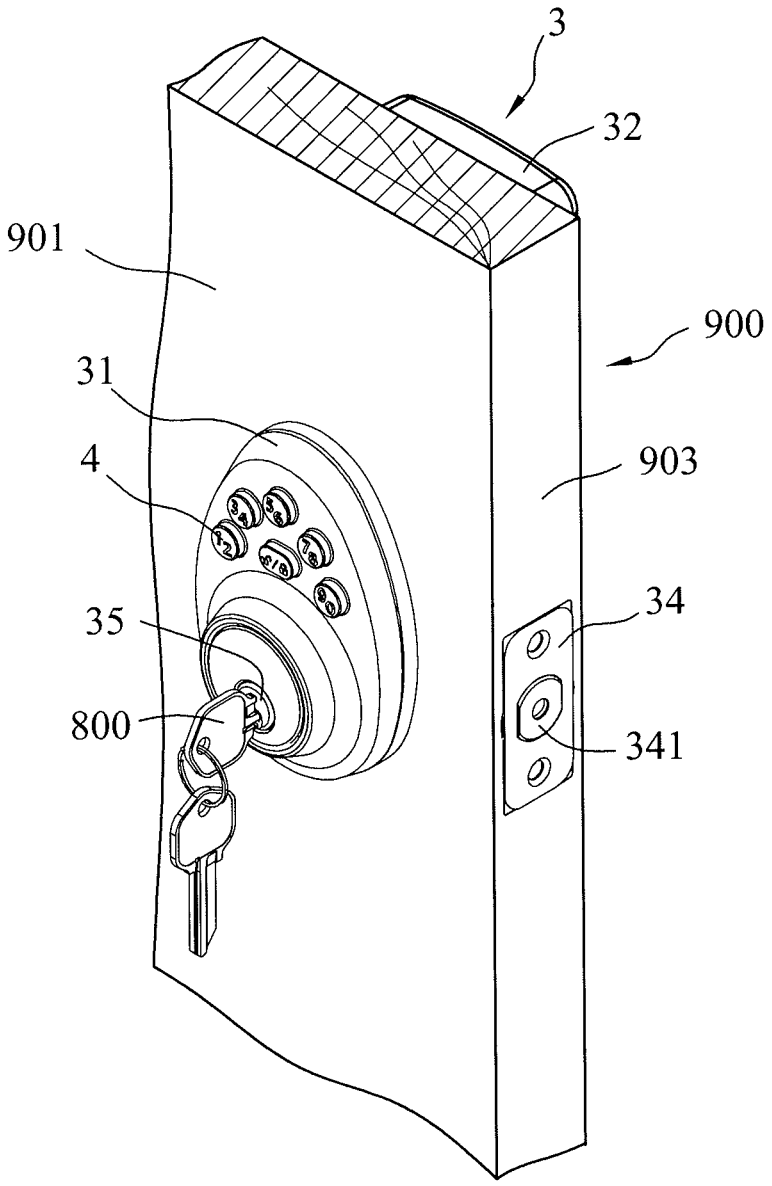
FIG. 1 is a perspective view illustrating an embodiment of the electronic lock according to this disclosure, where the electronic lock is installed to a door leaf.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
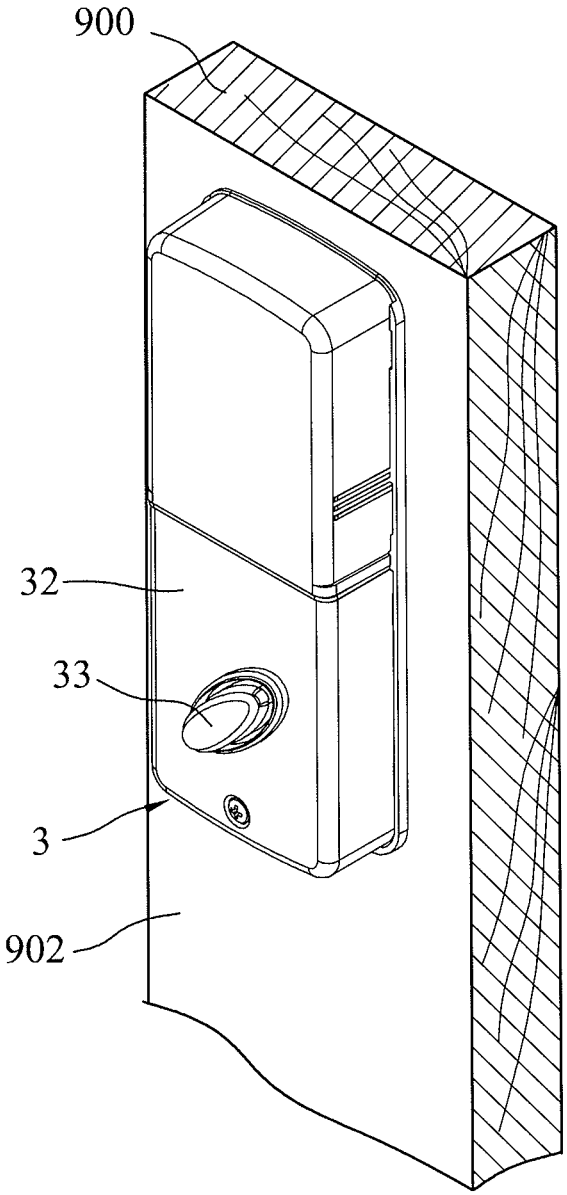
FIG. 2 is a perspective view of the embodiment from another angle.
Figure 3:
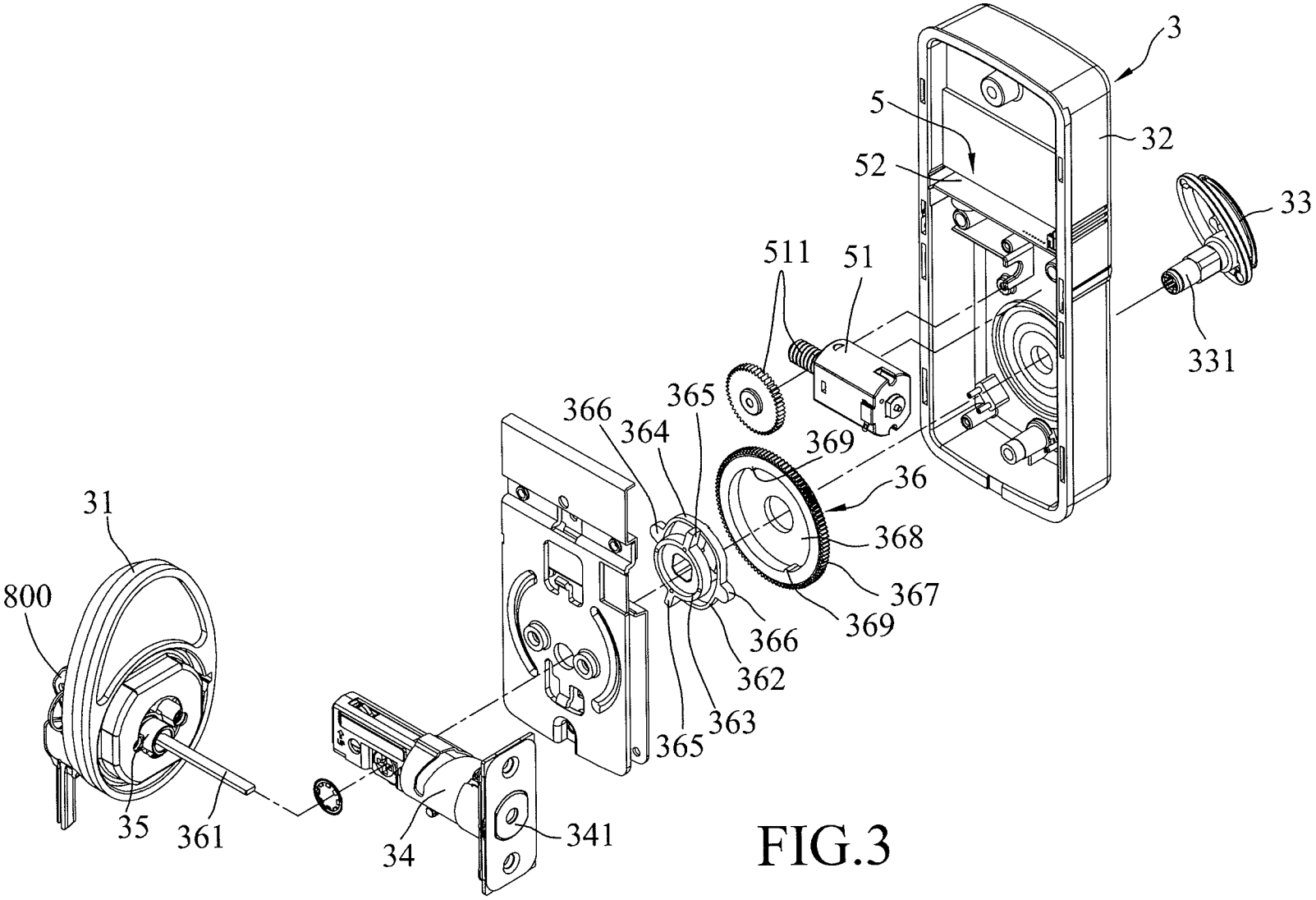
FIG. 3 is an exploded perspective view illustrating the embodiment.

Referring to FIGS. 1 to 3, the embodiment of the electronic lock according to this disclosure is adapted to be installed to a door leaf 900, so that the door leaf 900 can be locked to a door frame (not shown). The electronic lock includes a lock mechanism 3 that is installed to the door leaf 900, a user-input device 4 and an electric control device 5, where the user-input device 4 and the electric control device 5 are mounted on the lock mechanism 3. The lock mechanism 3 is configured to be driven by the electric control device 5 to change a state thereof between a lock state and an unlock state. In the lock state, the lock mechanism 3 engages the door frame such that the door leaf 900 is locked and cannot be opened relative to the door frame; in the unlock state, the lock mechanism 3 is disengaged from the door frame so that the door leaf 900 is unlocked and can be opened relative to the door frame.

The lock mechanism 3 includes an outer lock shell 31, an inner lock shell 32, a twist knob 33, a lock bolt module 34, a cylinder 35 and a transmission module 36. The outer lock shell 31 is to be fixed to a first door surface 901 of the door leaf 900 that is outside of a room, access to which is to be blocked off by the door leaf 900 when the door leaf 900 is closed (i.e., the first door surface 901 is an outer side door surface of the door leaf 900). The inner lock shell 32 is to be fixed to a second door surface 902 of the door leaf 900 that is opposite to the first door surface 901 and that is inside the room when the door leaf 900 is closed (i.e., the second door surface 902 is an inner side door surface of the door leaf 900). The twist knob 33 is rotatably mounted to and exposed from the inner lock shell 32. The lock bolt module 34 is configured to be driven for engaging the door frame. The cylinder 35 is mounted in and exposed from the outer lock shell 31. The transmission module 36 is physically connected to the lock bolt module 34, the twist knob 33 and the cylinder 35.

The twist knob 33 has an axial rod 331 rotatably inserted into the inner lock shell 32. The lock bolt module 34 is fixedly mounted to a third door surface 903 of the door leaf 900 that interconnects the first and second door surfaces 901, 902, and faces a strike plate (not shown) mounted to the door frame. It is noted that the state of the lock mechanism 3 herein refers to a position state of the lock bolt module 34. The lock bolt module 34 includes a lock bolt 341 that protrudes relative to the third door surface 903 when the position state thereof is in the lock state, and that retracts back when the position state thereof is in the unlock state. Since the lock bolt module 34 may be realized in various conventional ways and improvements of this disclosure over the prior art do not reside in this respect, details thereof are omitted herein for the sake of brevity. The cylinder 35 is configured for insertion of a key 800 to drive the transmission module 36 to provide a transmission force to change the position state of the lock bolt module 34.

Figure 5:
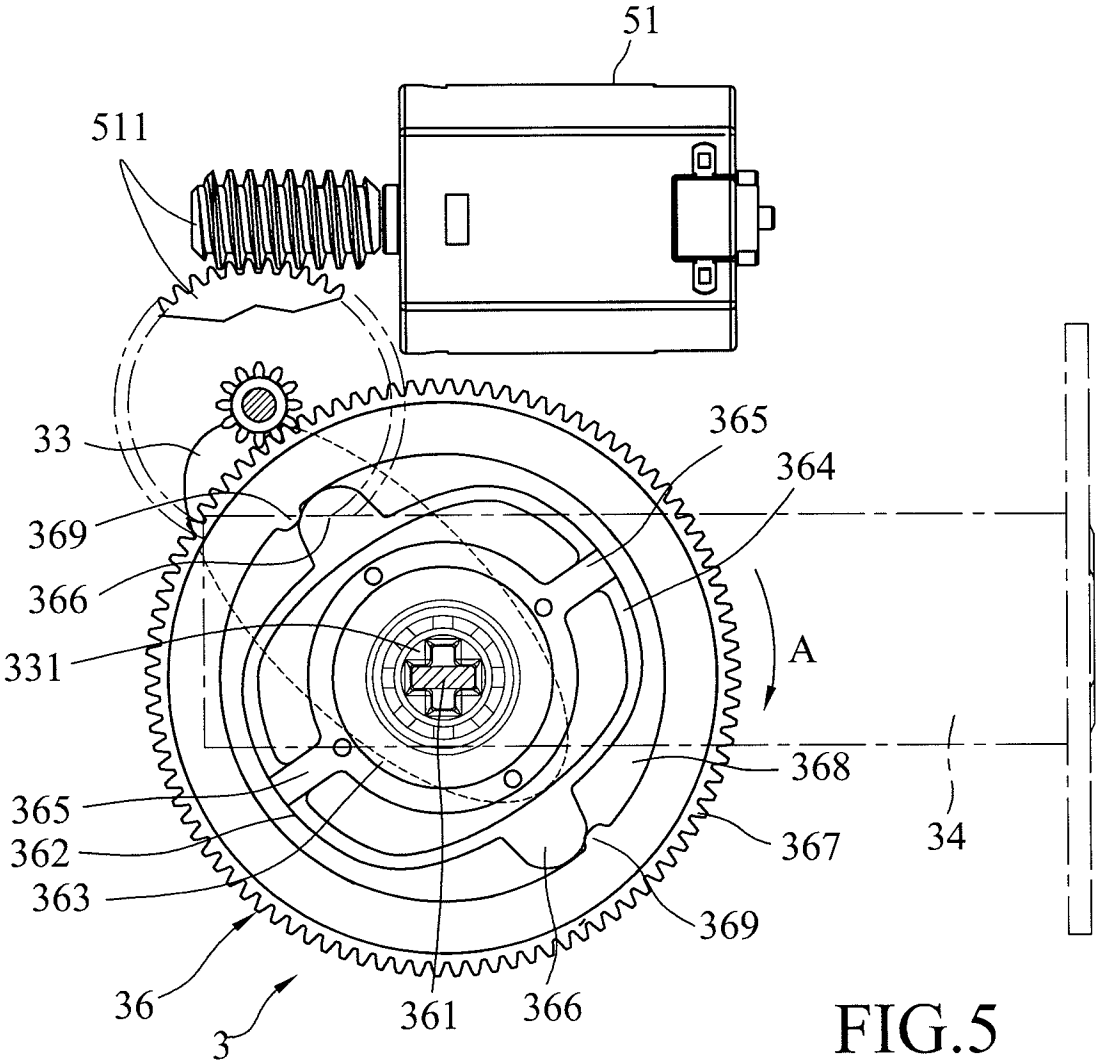
FIG. 5 is a side view of a part of the embodiment, illustrating that a lock mechanism of the embodiment is in an unlock state.
Figure 7:
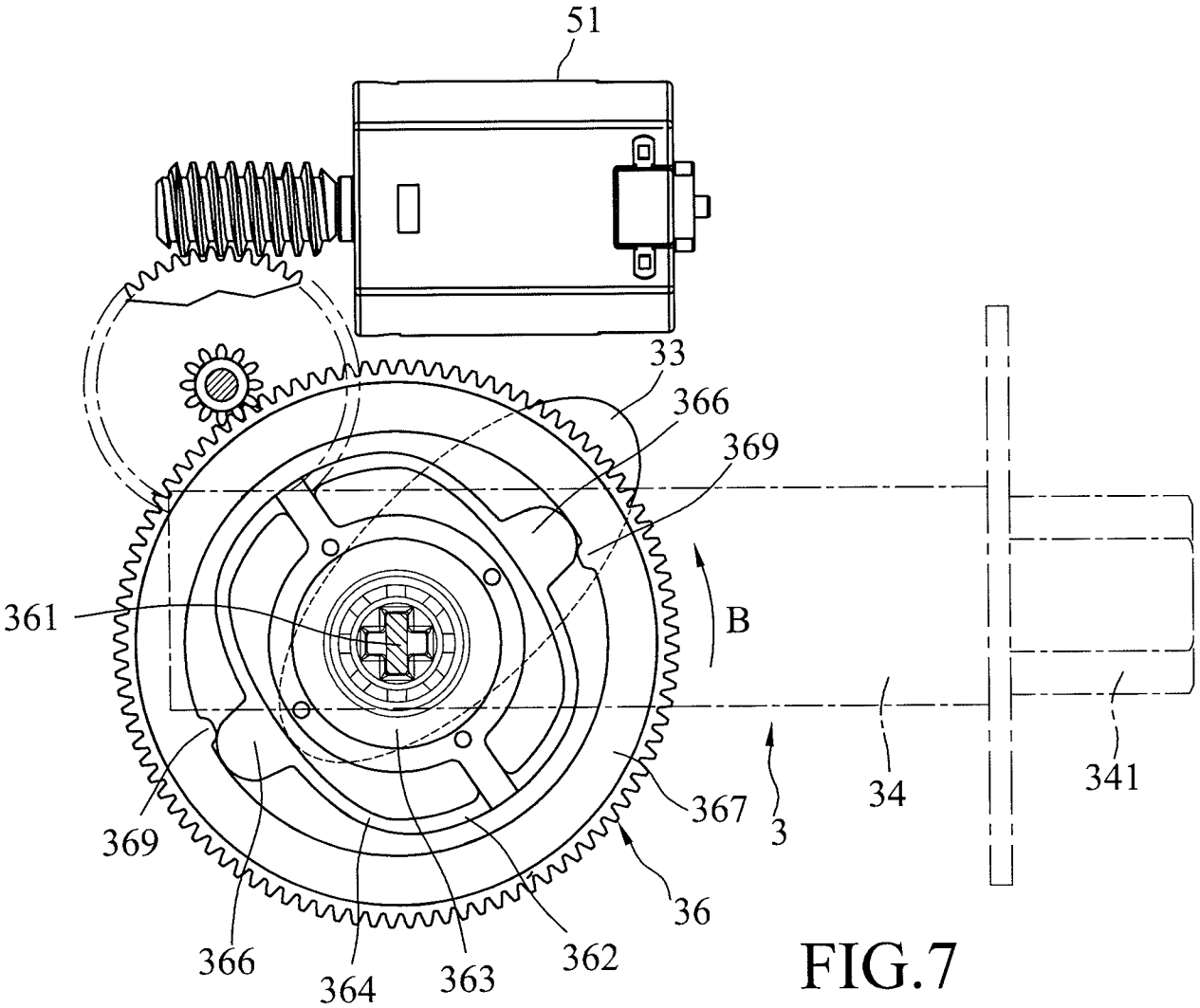
FIG. 7 is a side view of the part of the embodiment, illustrating that the lock mechanism of the embodiment is in the lock state.

Referring to FIGS. 3, 5 and 7, the transmission module 36 is operable to drive the lock bolt module 34 to change the position state of the lock bolt module 34 between the lock state and the unlock state, and includes a tailpiece 361, a rotary component 362, and a transmission wheel 367. The transmission wheel 367 is disposed within the inner lock shell 32, is rotatably sleeved on the axial rod 331, and is configured to be driven into rotation by the electric control device 5. The rotary component 362 is disposed within the inner lock shell 32, is rotatably and coaxially mounted to the transmission wheel 367, and is sleeved on the axial rod 331 in such a way that the rotary component 362 is rotatable together with rotation of the axial rod 331.

Figure 6:
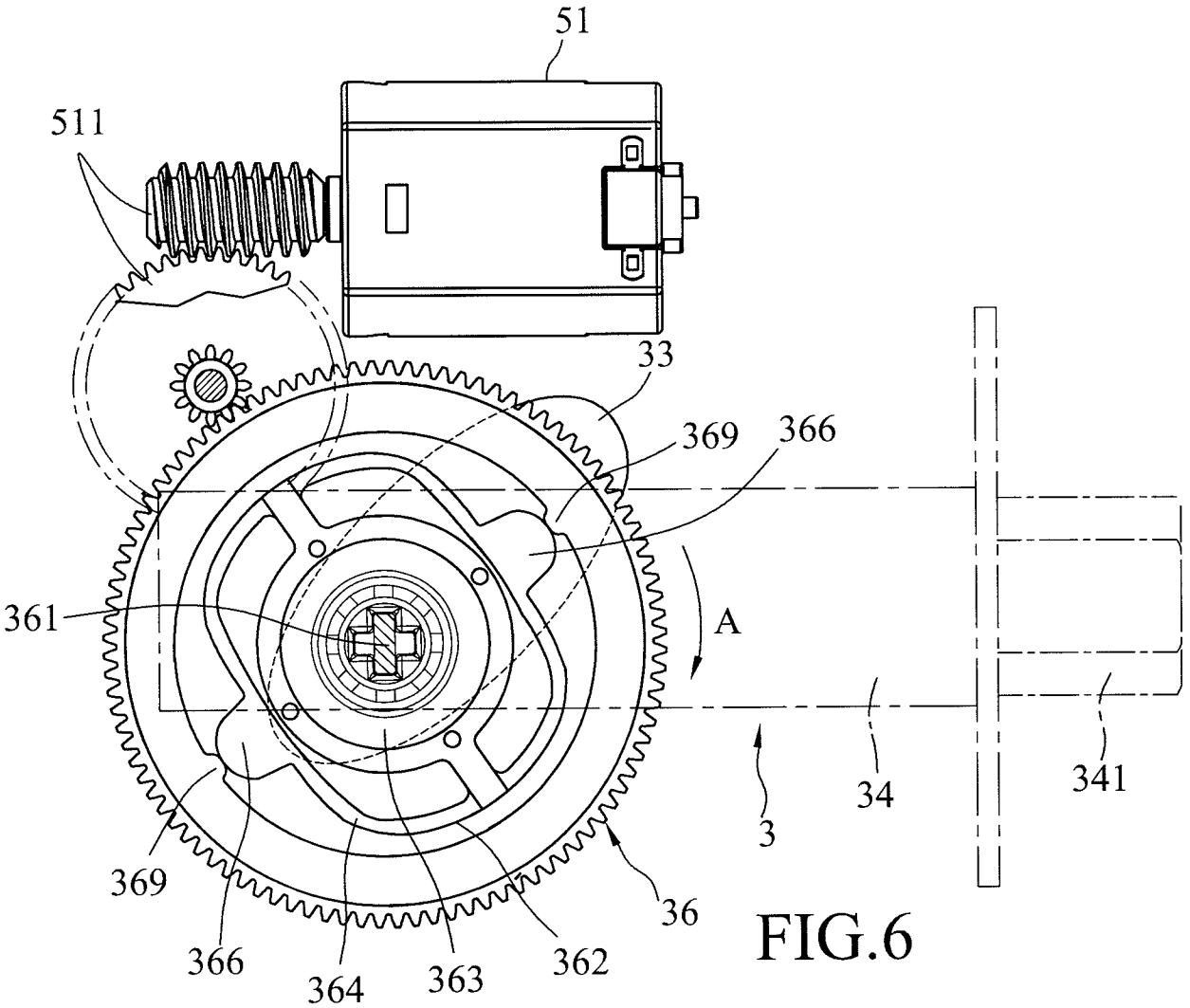
FIG. 6 is a side view of the part of the embodiment, illustrating a specific operation of this embodiment after the lock mechanism has just been successfully changed to a lock state.

The tailpiece 361 is connected to and driven by the cylinder 35, is connected to and extends through the lock bolt module 34, and is coaxially inserted into and engages the axial rod 331, so that the tailpiece 361 is rotatable by the cylinder 35 and/or the twist knob 33 so as to drive the lock bolt module 34 to change the position state between the lock state and the unlock state. Rotation of the tailpiece 361 during lock or unlock operation will be stopped by the lock bolt module 34 when the position state of the lock bolt module 34 has been changed to the lock state or the unlock state. In this embodiment, rotation of the tailpiece 361 is limited within a range of 90 degrees, e.g., between a horizontal position and a vertical position as shown in FIGS. 5 and 6, respectively.

In this embodiment, the transmission wheel 367 is a gear having an outer periphery meshing with the electric control device 5, and has a surrounding wall protruding toward the outer lock shell 31 and having an inner surface that defines a circular receiving space 368. The transmission wheel 367 further includes at least one transmission wheel protrusion 369 that radially protrudes from the inner surface of the surrounding wall into the circular receiving space 368. In this embodiment, the transmission wheel 367 has two transmission wheel protrusions 369, each of which has an arc contour in a side view (see FIGS. 5 and 6).

The rotary component 362 is coaxially mounted to the transmission wheel 367, and is rotatably disposed in the circular receiving space 368. The rotary component 362 has a body portion 363 that is sleeved on the axial rod 331 and that is not rotatable relative to the axial rod 331, an outer ring portion 364 that is spaced apart from and surrounds the body portion 363 and that is resiliently deformable, two connecting portions 365 that are radially spaced apart from each other and that interconnect the body portion 363 and the outer ring portion 364, and at least one rotary component protrusion 366 corresponding to the at least one transmission wheel protrusion 369. In this embodiment, the rotary component 32 has two of the rotary component protrusions 366 respectively corresponding to the transmission wheel protrusions 369. Each of the rotary component protrusions 366 radially protrudes from the outer ring portion 364 toward the surrounding wall of the transmission wheel 367, such that a periphery thereof can abut against that of the corresponding one of the transmission wheel protrusions 369 during rotation of the transmission wheel 367. In this embodiment, each of the rotary component protrusions 366 has an arc contour in a side view (see FIGS. 5 and 6).

The rotary component 362 is configured to rotate together with rotation of the twist knob 33, and is configured to be in a rotationally-positioned state in which the rotary component 362 is non-rotatable by the lock operation when the lock bolt module 34 is in the lock state, and is non-rotatable by the unlock operation when the lock bolt module 34 is in the unlock state. In more detail, the rotationally-positioned state may be classified into a rotationally-positioned lock state and a rotationally-positioned unlock state. When the lock bolt module 34 is in the lock state, the rotary component 362 is in the rotationally-positioned lock state and is non-rotatable by the lock operation; when the lock bolt module 34 is in the unlock state, the rotary component 362 is in the rotationally-positioned unlock state and is non-rotatable by the unlock operation. It is noted that, in this embodiment, the tailpiece 361, the rotary component 362 and the twist knob 33 are connected in such a way that rotation of each of them drives the other two into rotation, so that the tailpiece 361, the rotary component 362 and the twist knob 33 will rotate simultaneously within the same limited range of rotation (corresponding to a range between a position of the rotary component 362 in the rotationally-positioned lock state and a position of the rotary component 362 in the rotationally-positioned unlock state) during the lock operation and also during the unlock operation. The limited range of rotation of the tailpiece 361, the rotary component 362 and the twist knob 33 is 90 degrees in this embodiment. Moreover, the transmission wheel 367 is configured to drive the rotary component 362 into rotation when the transmission wheel 367 moves to push the rotary component 362 within the limited range of rotation by abutment between the rotary component protrusions 366 and the transmission wheel protrusions 369.

In particular, when the twist knob 33 is rotated by a user, the axial rod 331 of the twist knob 33 drives the tailpiece 361 and the rotary component 362 to rotate simultaneously. On the other hand, when the key 800 is rotated by a user to operate the cylinder 35, the tailpiece 361 is rotated by the cylinder 35 and thus drives the axial rod 331 of the twist knob 33 to rotate simultaneously, and then the axial rod 331 drives the rotary component 362 to rotate.

When the transmission wheel 367 is driven by the lock or unlock operation performed by the electric control device 5 to rotate in a condition that the rotary component 362 is not in the rotationally-positioned state, the transmission wheel protrusions 369 of the transmission wheel 367 may push the rotary component protrusions 366 of the rotary component 362, so as to generate a transmission force that is attributed to the electric control device 5 driving the transmission wheel 367, that is applied to the rotary component 362, and that drives the rotary component 362 to rotate simultaneously. At the same time, the twist knob 33 and the tailpiece 361 are brought into rotation simultaneously until the rotary component 362 reaches the rotationally-positioned state, which means that the lock bolt module 34 reaches the lock state or the unlock state. When the rotary component 362 has reached the rotationally-positioned state, the electric control device 5 may continue with the lock or unlock operation to drive the transmission wheel 367 to continuously push the rotary component protrusions 366 by the transmission wheel protrusions 369, causing the rotary component protrusions 366 to apply a resistance force to the transmission wheel protrusions 369 to resist rotation of the transmission wheel 367. In this situation, the resistance force may be a reaction force of the transmission force. The electric control device 5 may cause the transmission wheel 367 to increase the transmission force in response to increase of load (e.g., the resistance force) in order to make the transmission wheel protrusions 369 pass over the rotary component protrusions 366. After the transmission wheel 367 is driven by the electric control device 5 to overcome the resistance force between the rotary component protrusions 366 and the transmission wheel protrusions 369, the transmission wheel 367 may rotate relative to the rotary component 362, and the transmission wheel protrusions 369 pass over the rotary component protrusions 366. In particular, the outer ring portion 364 of the rotary component 362 is resiliently deformable in a radial direction, facilitating the transmission wheel protrusions 369 pass over the rotary component protrusions 366.

Figure 4:
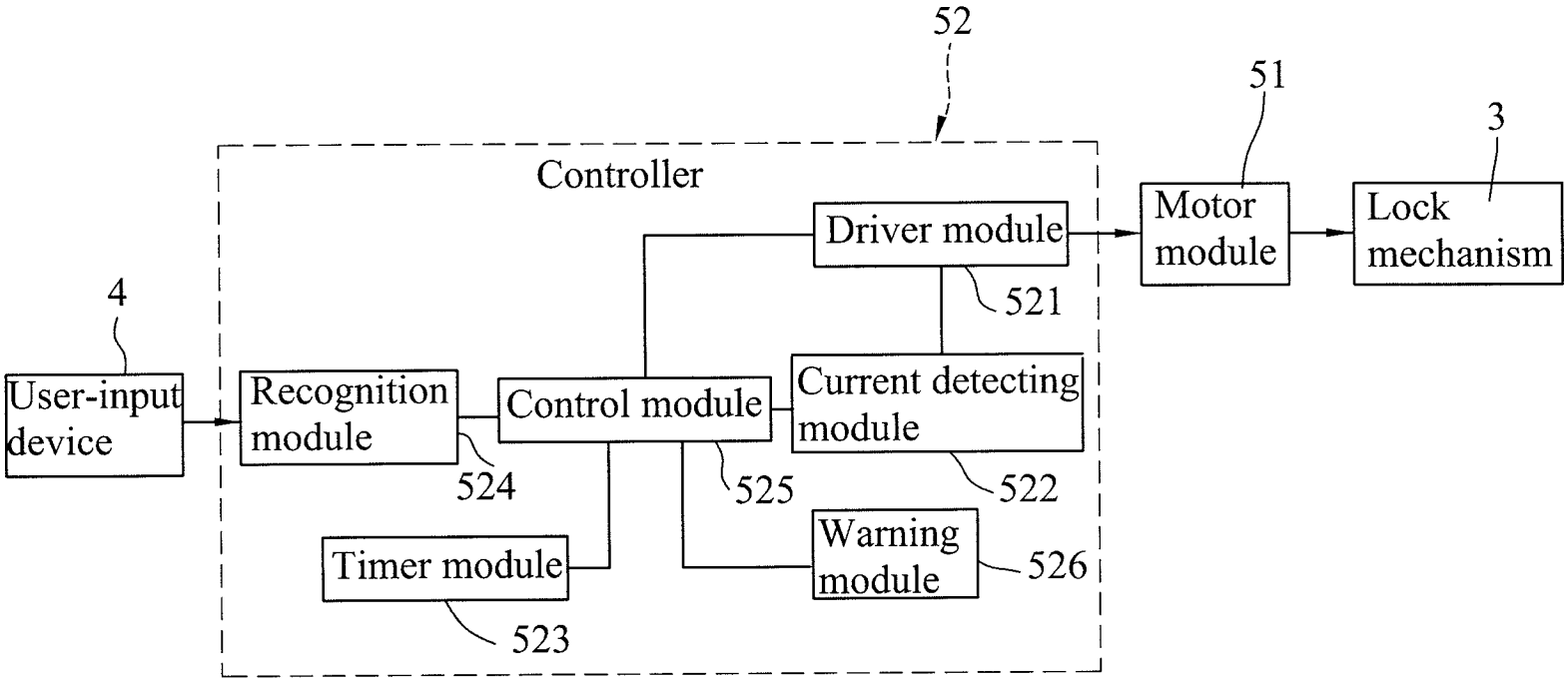
FIG. 4 is a functional block diagram of the embodiment.

Referring to FIGS. 1 and 4, the user-input device 4 is mounted on and exposed from the outer lock shell 31, and allows user operation to input an operation data piece (i.e., a piece of data) for execution of a lock function or an unlock function. In this embodiment, the user-input device 4 may be a keyboard for input of numerals, characters and/or symbols by pressing operation. In other embodiments, the user-input device 4 may be configured to support input of the operation data piece by handwriting, fingerprint detection, palm vein pattern detection, etc., and this disclosure is not limited in this respect.

Referring to FIGS. 4, 5 and 7, the electric control device 5 is installed within the inner lock shell 32, and includes a motor module 51 connected to the transmission wheel 367, and a controller 52 communicatively connected to the user-input device 4 and the motor module 51. The motor module 51 has a reduction gear assembly 511 meshing with the transmission wheel 367, and is electrically operable by the controller 52 to perform the lock operation and the unlock operation. In the lock operation, the motor module 51 causes the transmission module 36 to drive the lock bolt module 34 to change the position state to the lock state by, for example, driving the transmission wheel 367 to rotate in a clockwise direction (e.g., a direction (A) in FIG. 5); in the unlock operation, the motor module 51 causes the transmission module 36 to drive the lock bolt module 34 to change the position state to the unlock state by, for example, driving the transmission wheel 367 to rotate in a counterclockwise direction (e.g., a direction (B) in FIG. 7).

The controller 52 includes a driver module 521, a current detecting module 522, a timer module 523, a recognition module 524, a control module 525 and a warning module 526. The driver module 521 is electrically connected to the motor module 51, and is configured to output a driving current to the motor module 51 for driving operation of the motor module 51. When the resistance force applied to the transmission wheel 367 increases, which results in larger load for the motor module 51, the motor module 51 requires a greater output power to make the transmission wheel protrusions 369 pass over the rotary component protrusions 366. Accordingly, the driver module 521 increases a magnitude of the driving current in response to increase of the resistance force applied to the transmission wheel 367, so as to cause the transmission wheel 367 to provide a larger transmission force to overcome the resistance force, and the transmission wheel protrusions 369 pass over the rotary component protrusions 366. Since a variety of conventional methods can be employed to realize such function of the driver module 521, as should be familiar to persons with ordinary skill in the art, details thereof are omitted herein for the sake of brevity.

The current detecting module 522 is electrically connected to the driver module 521, and is disposed to detect the driving current (e.g., detecting the magnitude of the driving current) outputted by the driver module 521. Since a variety of conventional methods can be employed to realize current detection and these methods should be familiar to persons with ordinary skill in the art, details thereof are omitted herein for the sake of brevity.

The recognition module 524 is configured for storing a plurality of unlock data pieces and at least one lock data piece therein, is electrically connected to the user-input device 4 for receiving the operation data piece therefrom. The recognition module 524 is configured to analyze the operation data piece to determine whether the operation data piece matches one of the unlock data pieces and the at least one lock data piece, and to output to the control module 525, when the determination is affirmative, a control signal that includes a lock instruction or an unlock instruction that corresponds to the operation data piece to cause the control module 525 to initiate execution of the corresponding unlock function or lock function.

The control module 525 is electrically connected to the current detecting module 522, the timer module 523 and the recognition module 524, and is configured to initiate the lock function or the unlock function upon receipt of the lock instruction or the unlock instruction by controlling the driver module 521 to drive operation of the motor module 51, and controlling the timer module 523 to time an operation period when the control module 525 controls the driver module 521 to drive operation of the motor module 51. In this embodiment, the control module 525 is set with a predetermined current condition and a predetermined time condition. The predetermined current condition may relate to a current magnitude threshold that corresponds to the transmission force, and that may be determined in advance according to a magnitude of the driving current required for the motor module 51 to drive the transmission wheel 367 to generate the transmission force overcoming the resistance force from the rotary component protrusions 366 (i.e., to make the transmission wheel protrusions 369 pass over the rotary component protrusions 366). In one embodiment, the predetermined current condition may relate to a variation in magnitude of the driving current that corresponds to a variation of the transmission force to overcome the resistance force during a specific range for a rotation angle of the transmission wheel 367 relative to the rotary component 362. In this embodiment, the predetermined current condition requires the driving current to be greater than or equal to the current magnitude threshold, which means that the transmission wheel protrusions 369 are going to pass over the rotary component protrusions 366. In this embodiment, the predetermined time condition requires the operation period to be longer than or equal to a time length threshold which is determined in advance according to a time required for the driving current to reach the current magnitude threshold from the beginning of the lock operation or the unlock operation. The control module 525 determines that the lock bolt module 34 is currently in the lock state or the unlock state (i.e., the rotary component 362 is currently in the rotationally-positioned state) upon determining that both of the predetermined current condition and the predetermined time condition are satisfied.

Referring to FIGS. 4 and 5, when the control module 525 is triggered by the control signal that includes the lock instruction to initiate execution of the lock function, the control module 525 controls the driver module 521 to drive the motor module 51 to perform the lock operation. As a result, the motor module 51 drives the transmission wheel 367 to induce rotation of the rotary component 362 in the direction (A), causing engagement of the lock bolt module 34 to the door frame.

During the lock operation, the control module 525 analyzes the magnitude of the driving current detected by the current detecting module 522, and controls the driver module 521 to continuously drive the lock operation of the motor module 51 upon determining that the driving current does not satisfy the predetermined current condition, so as to cause the rotary component 362 to reach the rotationally-positioned state (see FIG. 6), and force the transmission wheel 367 to overcome the resistance force originating from the abutment between the transmission wheel protrusions 369 and the rotary component protrusions 366 when the rotary component 362 is in the rotationally-positioned state (e.g., at a position as shown in FIG. 6). Referring to FIG. 6, at a moment the transmission wheel protrusions 369 are going to pass over the rotary component protrusions 366 along the direction (A), the driving current reaches the current magnitude threshold because of increase of the resistance force, so that the predetermined current condition is satisfied.

Upon determining that the driving current satisfies the predetermined current condition, the control module 525 may immediately determine whether the operation period satisfies the predetermined time condition. Upon determining that the operation period satisfies the predetermined time condition, which means that the lock bolt module 34 is currently in the lock state, the control module 525 may control the driver module 521 to continuously drive the motor module 51 to perform the lock operation (i.e., causing the transmission wheel 367 to rotate in the direction (A)) for a predetermined time length (e.g., 0.5 seconds) to make each of the transmission wheel protrusions 369 completely pass over the corresponding rotary component protrusion 366 in the direction (A) and reach the clockwise side of the corresponding rotary component protrusion 366 (see FIG. 7). Then, the control module 525 controls the driver module 521 to stop driving operation of the motor module 51.

In some conditions that may result from the lock bolt 341 not completely projecting outward because of external forces, the control module 525 may determine that the operation period does not satisfy the predetermined time condition after determining that the predetermined current condition is satisfied. For example, in a case that the door leaf 900 (see FIG. 1) is not completely closed, extension of the lock bolt 341 may be blocked by the door frame, and the lock bolt 341 is thus unable to completely extend, so the rotary component 362 is unable to further rotate even if the rotary component 362 has not reached the rotationally-positioned state. In response to the obstacle in rotation of the rotary component 362, the driver module 521 may increase the driving current to induce higher output power of the motor module 51, and thus cause the transmission wheel protrusions 369 to pass over the rotary component protrusions 366, so the driving current may satisfy the predetermined current condition when the operation period has not reached the time length threshold (non-satisfaction of the predetermined time condition). At this time, the control module 525 may control the driver module 521 to drive the lock operation (e.g., causing the transmission wheel 367 to rotate in the clockwise direction, exemplified as direction (A) in FIGS. 5 and 6) of the motor module 51 for a predetermined time length (e.g., 0.5 seconds), making the transmission wheel protrusions 369 completely pass over the rotary component protrusions 366 in the direction (A), followed by controlling the driver module 521 to drive the unlock operation (e.g., causing the transmission wheel 367 to rotate in the counterclockwise direction, exemplified as direction (B) in FIG. 7), so as to make the transmission wheel 367 and the rotary component 362 return to respective original positions where the transmission wheel 367 and the rotary component 362 were positioned before the lock operation begun, and to make the lock bolt module 34 return to the unlock state, which is an original state before the lock operation. Then, the control module 525 may control the driving module 521 to drive the motor module 51 to perform the lock operation again.

Referring to FIGS. 4 and 7, in the abovementioned operation, when the motor module 51 changes the lock operation to the unlock operation because of the failed lock operation, since each of the transmission wheel protrusions 369 has rotated to the clockwise side of the corresponding rotary component protrusion 366, the counterclockwise rotation of the transmission wheel 367 in the direction (B) (unlock operation) will drive counterclockwise rotation of the rotary component 362, so as to bring the lock bolt module 34 back to the unlock state. After the lock bolt module 34 has completely returned to the unlock state, the rotary component 362 is in the rotationally-positioned state, and the control module 525 may control the driver module 521 to continuously drive the unlock operation of the motor module 51, such that the transmission wheel protrusions 369 pass over the rotary component protrusions 366 in the direction (B). In detail, the control module 525 continuously analyzes whether the driving current satisfies the predetermined current condition; upon determining that the driving current satisfies the predetermined current condition, the control module 525 may control the driver module 521 to further drive the unlock operation of the motor module 51 for the predetermined time length (e.g., 0.5 seconds), making the transmission wheel protrusions 369 completely pass over the rotary component protrusions 366 in the direction (B), followed by stopping driving operation of the motor module 51. At this time, the lock mechanism 3 has returned to the original state (unlock state) that is a state before the lock operation begun.

Then, the control module 525 may determine whether a number of times the lock mechanism 3 has returned to the original state has accumulated to a predetermined number which may be an integer not smaller than two. Upon determining that the number of times has not accumulated to the predetermined number, the control module 525 may repeat execution of the desired function (e.g., the lock function executed in the abovementioned exemplary operation), and control the timer module 523 to re-time the operation period during the repetition. Upon determining that the number of times has accumulated to the predetermined number, the control module 525 may control the warning module 526 to issue a warning message to notify the user to check the door leaf 900, and may control the driver module 521 to stop operation of the motor module 51.

The execution principle of the unlock function is similar to that of the lock function, and differs from the lock function only in that each of the transmission wheel 367 and the rotary component 362 is driven to rotate in a direction different from that in the execution of the lock function. Similarly, whether the lock mechanism 3 has been successfully changed to the unlock state may be determined based on the predetermined current condition and the predetermined time condition. Accordingly, details of the execution of the unlock function are omitted herein for the sake of brevity.

Figure 8:
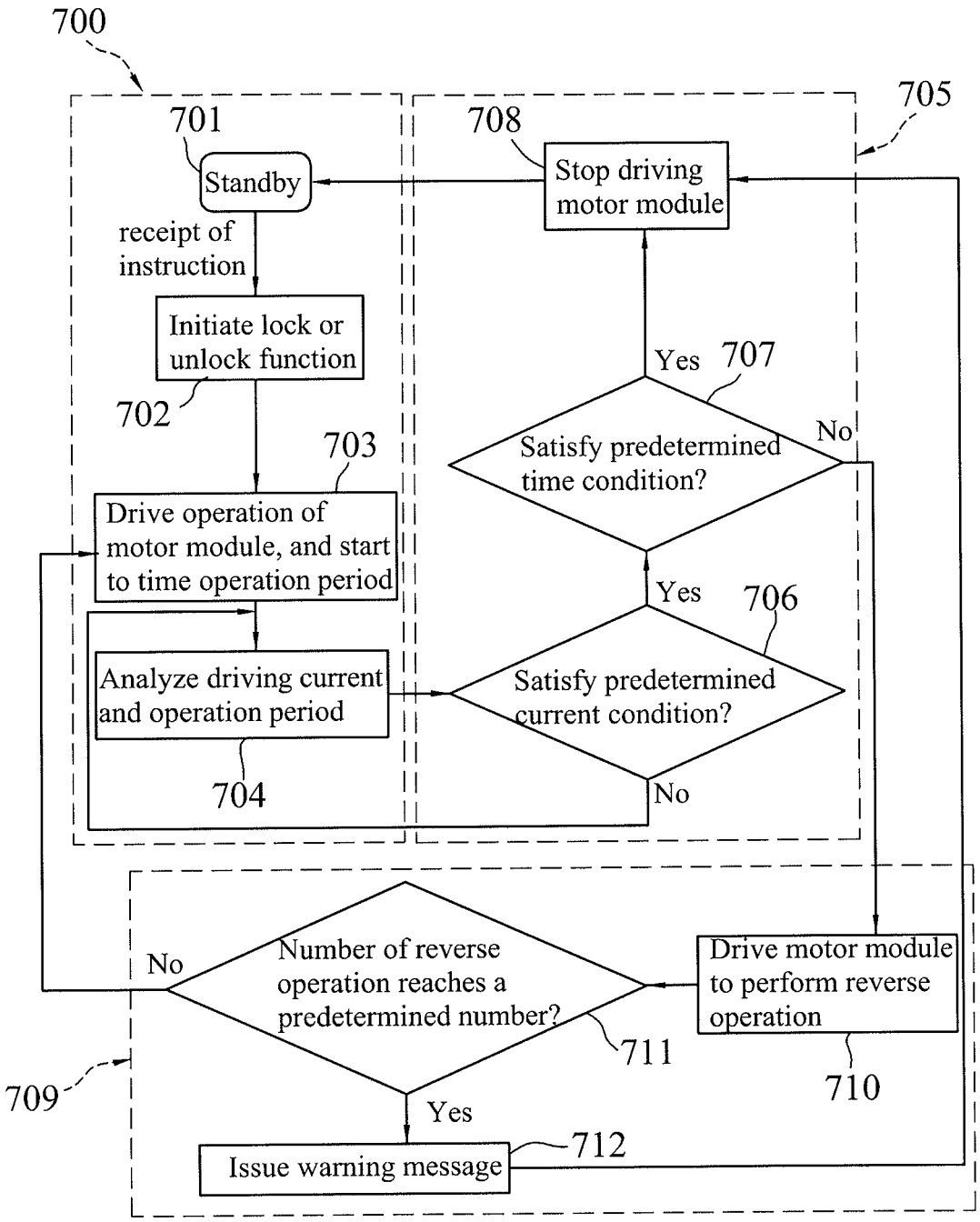
FIG. 8 is a flow chart illustrating steps of a method for positioning of the embodiment according to this disclosure.

Referring to FIGS. 4 and 8, the method for positioning of the electronic lock according to this disclosure are illustrated to include primary steps 700, 705 and 709.

In step 700, the control module 525 initiates execution of the lock or unlock function, controls the current detecting module 522 to detect the driving current, and controls the timer module 523 to time the operation period. Step 700 includes sub-steps 701 to 704. In sub-step 701, the control module 525 is in a standby state to wait for incoming instructions. Upon receipt of an instruction (the lock instruction or the unlock instruction), the control module 525 initiates the lock function or the unlock function based on the received instruction in sub-step 702. In sub-step 703, the motor module 51 is driven to start the lock operation during execution of the lock function, or to start the unlock operation during execution of the unlock function, and the timer module 523 starts to time the operation period. In sub-step 704, the control module 525 acquires and analyzes information relating to the driving current and the operation period received from the current detecting module 522 and the timer module 523, respectively.

In step 705, the control module 525 determines the subsequent actions to be performed based on the predetermined current condition and the predetermined time condition, and step 705 includes sub-steps 706 to 708. Step 709 illustrates the actions to be performed after the control module 525 determines that the predetermined time condition is not satisfied, and includes sub-steps 710 to 712.

In sub-step 706, the control module 525 determines whether the driving current satisfies the predetermined current condition. The flow goes to sub-step 707 when the determination is affirmative, and goes back to sub-step 704 when otherwise. In sub-step 707, the control module 525 determines whether the operation period satisfies the predetermined time condition. The flow goes to sub-step 708 when the determination is affirmative, and goes to sub-step 710 when otherwise. In sub-step 708, the operation of the motor module 51 is stopped, and the flow goes back to sub-step 701.

In sub-step 710, the motor module 51 is driven to perform a reverse operation, i.e., the unlock operation during the execution of the lock function, or the lock operation during the execution of the unlock function, such that the transmission wheel 367 and the rotary component 362 return to an original state (or original positions) that is a state before execution of the lock or unlock function which was initiated in sub-step 702. In sub-step 711, the control module 525 determines whether a number of times the lock mechanism 3 has returned to the original state has accumulated to the predetermined number. The flow goes to sub-step 712 when the determination is affirmative, and goes back to sub-step 703 when otherwise. In sub-step 712, the control module 525 controls the warning module 526 to issue the warning message, and the flow goes to sub-step 708.

By virtue of such design, when the electronic lock is operated to electrically execute the lock function through the user-input device 4, the control module 525 may accurately determine whether the lock mechanism 3 is successfully locked and properly positioned without use of electronic switch components, and may perform re-trial of the lock function upon determining that the lock operation is not successfully completed. Furthermore, the electronic lock may issue a warning message upon consecutive failures of the lock operations during execution of the lock function.

In addition, since the electronic lock is configured to make the transmission wheel protrusions 369 pass over the rotary component protrusions 366 in a successful lock operation (i.e., the lock mechanism 3 is in the lock state), as shown in FIG. 7, the transmission wheel 367 may directly and instantly drive rotation of the rotary wheel 362 in the direction (B) when the user-input device 4 is used to trigger the unlock function in a manner of electric control, resulting in fast response to the user operation.

In this embodiment, the lock mechanism 3 includes the cylinder 35 to permit locking or unlocking using a key, but the cylinder 35 may be omitted in other embodiments, without affecting the lock and unlock operations via electric control.

In this embodiment, the transmission module 36 is configured such that the resistance force increases when the lock bolt module 34 is in the lock state or the unlock state, thereby resulting in increase of the driving current; the control module 525 can thus determine whether the desired lock or unlock operation is successfully completed by determining whether the driving current is greater than or equal to the current magnitude threshold. In other embodiments, the transmission module 36 may be configured such that the resistance force decreases when the lock bolt module 34 is in the lock state or the unlock state, thereby resulting in reduction of the driving current, and the current magnitude threshold may be defined accordingly; the control module 525 can thus determine whether the desired lock or unlock operation is successfully completed by determining whether the driving current is smaller than or equal to the current magnitude threshold.

It is noted that, when the door leaf 900 is normally closed, the control module 525 can determine whether the desired lock or unlock operation is successfully completed based on only the predetermined current condition. Accordingly, the determination for the predetermined time condition may be omitted in other embodiments.

The described operations of the driver module 521, the current detecting module 522, the timer module 523, the recognition module 524, the control module 525 and the warning module 526 of the controller 52 may be implemented as a method, apparatus, logic circuit or computer readable storage medium using standard programming and/or engineering techniques to produce software, firmware, hardware, or any combination thereof. The described operations may be implemented as code or logic maintained in a "computer readable storage medium", which may directly execute the functions or a processor may read and execute the code from the computer storage readable medium. The computer readable storage medium includes at least one of electronic circuitry, storage materials, inorganic materials, organic materials, biological materials, a casing, a housing, a coating, and hardware. A computer readable storage medium may include, but is not limited to, a magnetic storage medium (e.g., hard disk drives, floppy disks, tape, etc.), optical storage (CD-ROMs, DVDs, optical disks, etc.), volatile and non-volatile memory devices (e.g., EEPROMs, ROMs, PROMs, RAMs, DRAMs, SRAMs, flash memory, firmware, programmable logic, etc.), solid state devices (SSD), etc. The computer readable storage medium may further comprise digital logic implemented in a hardware device (e.g., an integrated circuit chip, a programmable logic device, a programmable gate array (PGA), field-programmable gate array (FPGA), application specific integrated circuit (ASIC), etc.). Still further, the code implementing the described operations may be implemented in "transmission signals", where transmission signals may propagate through space or through a transmission media, such as an optical fiber, copper wire, etc. The transmission signals in which the code or logic is encoded may further comprise a wireless signal, radio waves, infrared signals, Bluetooth, etc. The program code embedded on a computer readable storage medium may be transmitted as transmission signals from a transmitting station or computer to a receiving station or computer. A computer readable storage medium is not comprised solely of transmission signals, but includes tangible components, such as hardware elements. Those skilled in the art will recognize that many modifications may be made to this configuration without departing from the scope of the present disclosure, and that the article of manufacture may comprise suitable information bearing medium known in the art.

In summary, the electric control device 5 may position the lock mechanism 3 based on the predetermined current condition, and may further determine whether the lock mechanism 3 is accurately locked or unlocked based on the predetermined time condition, so no electronic switch components are needed, thereby reducing cost in manufacturing, and preventing malfunction due to abnormal operations of the electronic switch components in the conventional electronic locks.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. An electronic lock, comprising:

a lock mechanism including a lock bolt module operable to change a position state thereof between a lock state and an unlock state, and a transmission module connected to said lock bolt module, said transmission module being operable to drive said lock bolt module to change the position state; and an electric control device including:

a motor module connected to said transmission module, and electrically operable to perform a lock operation in which said motor module causes said transmission module to drive said lock bolt module to change the position state to the lock state, and an unlock operation in which said motor module causes said transmission module to drive said lock bolt module to change the position state to the unlock state; and a controller including:

a driver module electrically connected to said motor module, and configured to output a driving current to said motor module for driving operation of said motor module;

a current detecting module disposed to detect the driving current; and a control module electrically connected to said driver module and said current detecting module, and configured to control said driver module to drive operation of said motor module upon receipt of one of a lock instruction and an unlock instruction;

wherein said control module is further configured to, when said lock bolt module changes the position state thereof, determine whether the driving current detected by said current detecting module satisfies a predetermined current condition, and control said driver module to stop driving operation of said motor module after determining at least that the driving current detected by said current detecting module satisfies the predetermined current condition, wherein when said lock bolt module changes the position state thereof, said transmission module has a variation in a transmission force attributed to said motor module driving said transmission module, the variation in the transmission force corresponding to a variation of the driving current, wherein the predetermined current condition relates to a current magnitude threshold corresponding to the variation of the transmission force.

2. The electronic lock of claim 1, wherein said transmission module includes:

a tailpiece connected to said lock bolt module, and operable to drive said lock bolt module to change the position state thereof;

a rotary component connected to said tailpiece, rotatable to drive said tailpiece to cause said lock bolt module to change the position state thereof, and configured to be in a rotationally-positioned state in which said rotary component is non-rotatable by the lock operation of said motor module when said lock bolt module is in the lock state, and non-rotatable by the unlock operation of said motor module when said lock bolt module is in the unlock state; and a transmission wheel connected between said rotary component and said motor module, operable by said motor module to rotate and to apply the transmission force to said rotary component so as to rotate said rotary component, said rotary component applying a resistance force to said transmission wheel to resist rotation of said transmission wheel when said rotary component is in the rotationally-positioned state;

wherein said control module is configured to, when said rotary component reaches the rotationally-positioned state during operation of said motor module in one of the lock operation and the unlock operation, control said driver module to continuously drive said motor module in a manner of said one of the lock operation and the unlock operation, so as to cause said transmission wheel to overcome the resistance force and to rotate relative to said rotary component.

3. The electronic lock of claim 2, wherein said transmission wheel is a gear meshing with said motor module, and includes a surrounding wall having an inner surface that defines a circular receiving space, and at least one transmission wheel protrusion that radially protrudes from said inner surface into said circular receiving space;

wherein said rotary component is rotatably disposed within said circular receiving space, and includes an outer ring portion, and at least one rotary component protrusion that radially protrudes from said outer ring portion toward said surrounding wall; and wherein said at least one rotary component protrusion abuts against said at least one transmission wheel protrusion when said transmission wheel is driven by said motor module to rotate said rotary component.

4. The electronic lock of claim 3, wherein said outer ring portion of said rotary component is resiliently deformable, and is deformed by said at least one transmission wheel protrusion during said transmission wheel overcoming the resistance force.

5. The electronic lock of claim 1, wherein said controller further includes a timer module electrically connected to said control module, and configured to time an operation period when said control module controls said driver module to drive operation of said motor module;

wherein said control module is further configured to, upon determining that the driving current detected by said current detecting module satisfies the predetermined current condition, determine whether the operation period timed by said timer module satisfies a predetermined time condition, and to control said driver module to stop driving operation of said motor module upon determining that the operation period satisfies the predetermined time condition.

6. The electronic lock of claim 5, wherein said control module is further configured to, upon determining that the operation period does not satisfy the predetermined time condition, control said driver module to change operation of said motor module from one of the lock operation and the unlock operation to the other one of the lock operation and the unlock operation, so that said lock bolt module returns to an original state that is one of the lock state and the unlock state said lock bolt module was in before said one of the lock operation and the unlock operation.

7. The electronic lock of claim 6, wherein said control module is further configured to, after said lock bolt module returns to the original state, control said driver module to drive said motor module to perform said one of the lock operation and the unlock operation again.

8. An electric control device for use in an electronic lock that includes a lock mechanism operable to change a state thereof between a lock state and an unlock state, said electric control device comprising:

a motor module connected to said lock mechanism, and electrically operable to perform a lock operation in which said motor module causes said lock mechanism to change the state to the lock state, and an unlock operation in which said motor module causes said lock mechanism to change the state to the unlock state; and a controller including:

a driver module electrically connected to said motor module, and configured to output a driving current to said motor module for driving operation of said motor module;

a current detecting module disposed to detect the driving current; and a control module electrically connected to said driver module and said current detecting module, and configured to control said driver module to drive operation of said motor module upon receipt of one of a lock instruction and an unlock instruction;

wherein said control module is further configured to, when said lock mechanism changes the position state thereof, determine whether the driving current detected by said current detecting module satisfies a predetermined current condition, and control said driver module to stop driving operation of said motor module after determining at least that the driving current detected by said current detecting module satisfies the predetermined current condition, wherein when the lock mechanism changes the state thereof, the lock mechanism having a variation in a transmission force attributed to said motor module driving the lock mechanism, the variation in the transmission force corresponding to a variation of the driving current, wherein the predetermined current condition relates to a current magnitude threshold corresponding to the variation of the transmission force.

9. The electric control device of claim 8, wherein said controller further includes a timer module electrically connected to said control module, and configured to time an operation period when said control module controls said driver module to drive operation of said motor module;

wherein said control module is further configured to, upon determining that the driving current detected by said current detecting module satisfies the predetermined current condition, determine whether the operation period timed by said timer module satisfies a predetermined time condition, and to control said driver module to stop driving operation of said motor module upon determining that the operation period satisfies the predetermined time condition.

10. The electric control device of claim 9, wherein said control module is further configured to, upon determining that the operation period does not satisfy the predetermined time condition, control said driver module to change operation of said motor module from one of the lock operation and the unlock operation to the other one of the lock operation and the unlock operation, so that said lock bolt module returns to an original state that is one of the lock state and the unlock state said lock bolt module was in before said one of the lock operation and the unlock operation.

11. The electric control device of claim 10, wherein said control module is further configured to, after said lock mechanism returns to the original state, control said driver module to drive said motor module to perform said one of the lock operation and the unlock operation again.

12. A method for positioning of an electronic lock that includes a lock mechanism and a motor module, the lock mechanism including a lock bolt module operable to change a position state thereof between a lock state and an unlock state, and a transmission module connected to the lock bolt module and operable to drive the lock bolt module to change the position state, the method comprising steps of:

step A) detecting a driving current that is used to drive operation of the motor module in one of a lock operation in which the motor module causes the transmission module to drive the lock bolt module to change the position state to the lock state, and an unlock operation in which the motor module causes the transmission module to drive the lock bolt module to change the position state to the unlock state; and step B) upon determining at least that the driving current detected in step (A) satisfies a predetermined current condition, stopping operation of the motor module;

wherein when the lock bolt module changes the position state thereof, the transmission module has a variation in a transmission force that is attributed to the motor module driving the transmission module, and the variation in the transmission force causes a variation of the driving current;

wherein the predetermined current condition relates to a current magnitude threshold corresponding to the variation of the transmission force.

13. The method of claim 12, further comprising a step of:

step C) timing an operation period when the motor module is driven to cause the lock mechanism to change the operation state thereof;

wherein step B) includes, upon determining the driving current detected in step A) satisfies the predetermined current condition, determining whether the operation period timed in step C) satisfies a predetermined time condition, and stopping operation of said motor module upon determining that the operation period satisfies the predetermined time condition.

14. The method of claim 13, further comprising:

step D) upon determining that the operation period does not satisfy the predetermined time condition in step B), changing operation of the motor module from one of the lock operation and the unlock operation to the other one of the lock operation and the unlock operation, so that the lock bolt module returns to an original state that is one of the lock state and the unlock state the lock bolt module was in before said one of the lock operation and the unlock operation.

15. The method of claim 14, further comprising, after the lock bolt module returns to the original state, repeating step A), step B), and step C).

16. The method of claim 14, further comprising:

after the lock mechanism returns to the original state, determining whether a number of times the lock mechanism has returned to the original state has accumulated to a predetermined number that is an integer not smaller than two;

upon determining that the number of times has not accumulated to the predetermined number, repeating step A), step B), and step C); and upon determining that the number of times has accumulated to the predetermined number, issuing a warning message and stopping operation of the motor module.

17. The method of claim 12, wherein the transmission module has a variation in a transmission force that is attributed to the motor module driving the transmission module, and the variation in the transmission force causes a variation of the driving current;

wherein the predetermined current condition relates to a current magnitude threshold corresponding to the variation of the transmission force; and wherein the lock mechanism further includes:

a rotary component connected to the lock bolt module, rotatable to cause the lock bolt module to change the position state thereof, and configured to be in a rotationally-positioned state in which the rotary component is non-rotatable by the lock operation of the motor module when said lock bolt module is in the lock state, and non-rotatable by the unlock operation of the motor module when the lock bolt module is in the unlock state; and a transmission wheel connected between the rotary component and the motor module, operable by the motor module to rotate and to apply the transmission force to the rotary component so as to rotate the rotary component, the rotary component applying a resistance force to the transmission wheel to resist rotation of the transmission wheel when the rotary component is in the rotationally-positioned state;

said method further comprising steps of:

controlling the motor module to drive rotation of the transmission wheel during operation of the motor module in one of the lock operation and the unlock operation;

controlling, when the rotary component reaches the rotationally-positioned state during operation of the motor module in one of the lock operation and the unlock operation, the motor module to continuously drive rotation of the transmission wheel in a manner of the one of the lock operation and the unlock operation, so as to cause the rotation of the transmission wheel to overcome the resistance force and to rotate relative to the rotary component.

* * * * *